US005467545A

United States Patent [19]

Zillner

[11] Patent Number: 5,467,545

[45] Date of Patent: Nov. 21, 1995

[54] ASSEMBLIES TO DETERMINE THE STATE OF CLEANLINESS OF DISHES IN A DISHWASHER

[76] Inventor: Jospeh W. Zillner, 721-B Edgewater Dr., Chula Vista, Calif. 91913

[21] Appl. No.: 236,187

[22] Filed: May 2, 1994

[51] Int. Cl.[6] ..... G09F 7/00

[52] U.S. Cl. ..... 40/597; 40/617; 40/907

[58] Field of Search ..... 40/597, 617, 907; 248/205.2, 205.3, 239, 206.2, 304, 303, 301; D20/42

[56] References Cited

U.S. PATENT DOCUMENTS

| | | | |
|---|---|---|---|
| D. 317,944 | 7/1991 | George | 40/597 X |
| 2,965,978 | 12/1960 | Olson | 40/657 |

FOREIGN PATENT DOCUMENTS

| | | | |
|---|---|---|---|
| 31613 | 11/1963 | German Dem. Rep. | 248/206.2 |
| 2443587 | 3/1976 | Germany | 248/206.2 |

*Primary Examiner*—Kenneth J. Dorner

*Assistant Examiner*—Cassandra Davis

[57] ABSTRACT

An assembly to determine the state of conditions comprising a sign having a lower portion, an essentially triangular upper portion, a hole through the center of the triangular portion, and writing on one side of the sign with a first word and writing on another side of the sign with a second word; a suction cup having an inboard segment and an outboard segment, the inboard segment being generally hemispheric in configuration with a periphery adapted to contact a recipient surface and when pressed thereagainst to be held by suction thereto, the outboard segment having a cylindrical exterior cross-section with a central cylindrical recess; and a wire eyelet having an interior portion and an exterior portion, the interior portion being generally linear in extent with a prong at its inboard end positionable within the recess of the suction cup, the exterior portion of the eyelet being formed in a generally circular loop extended within the hole on the sign and positioned in a vertical plane, whereby the sign may depend in another vertical plane to display one side of the sign and whereby the eyelet may be turned 180 degrees within the suction cup to display the other side of the sign.

2 Claims, 4 Drawing Sheets

FIG 3
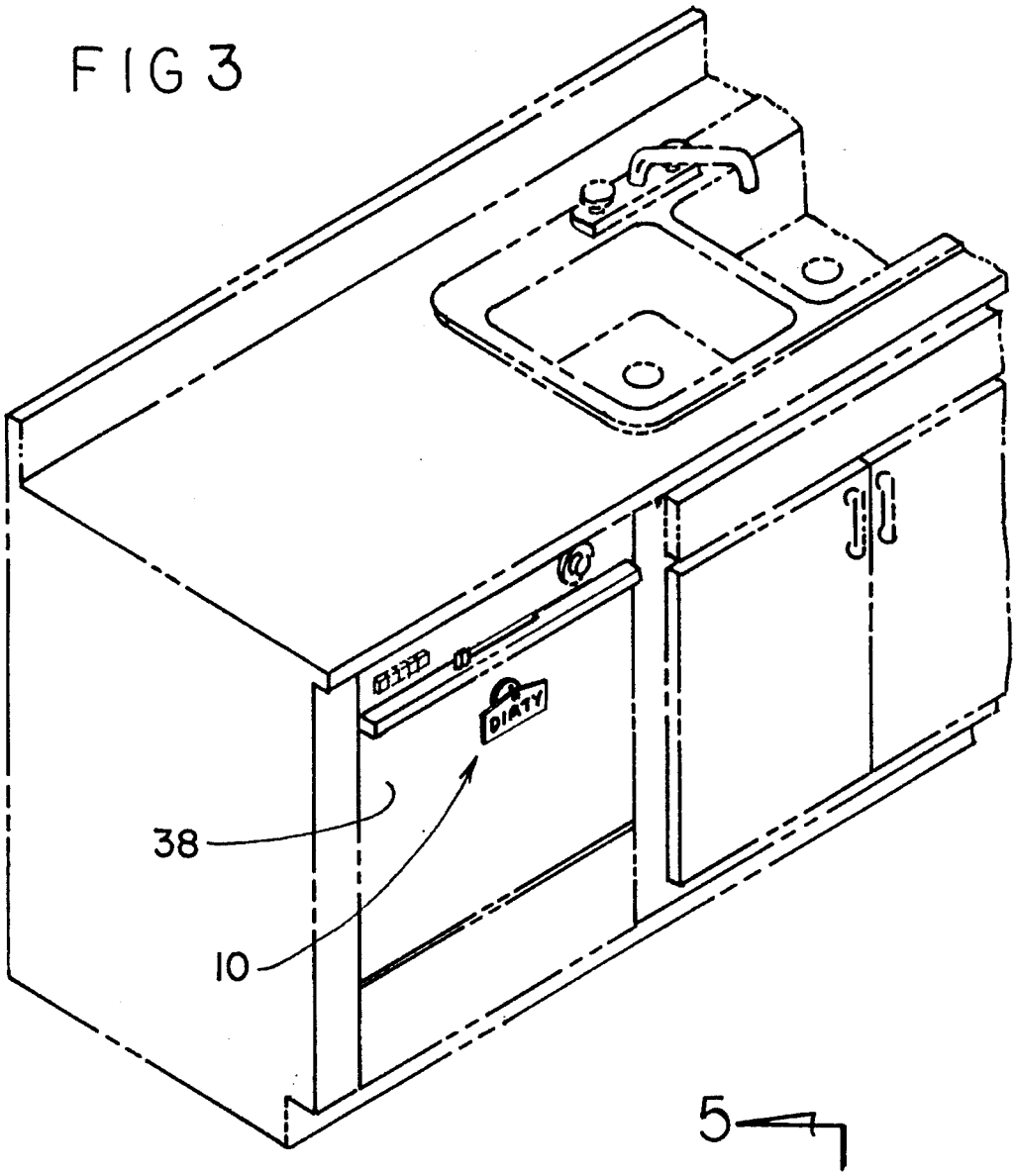
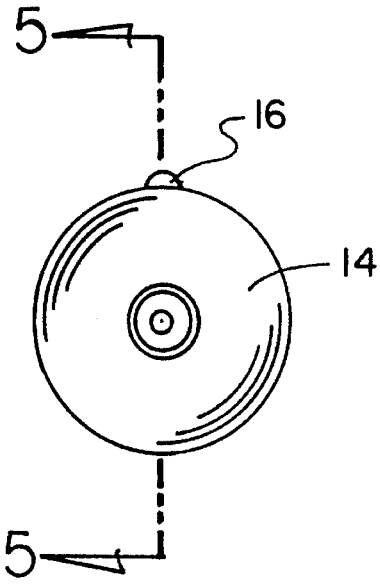
FIG 4

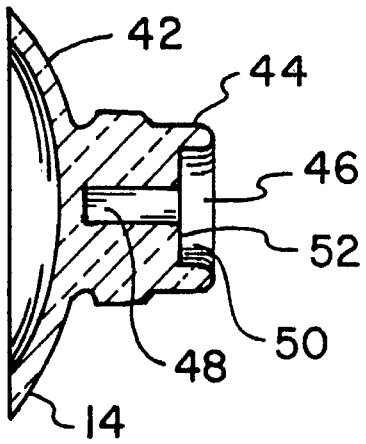
FIG 5
FIG 6
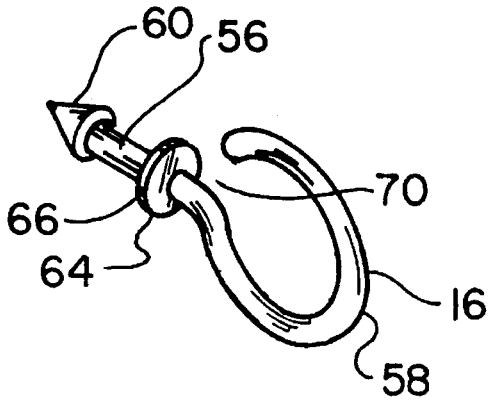
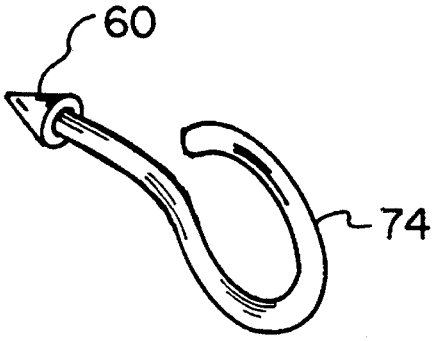
FIG 7

ASSEMBLIES TO DETERMINE THE STATE OF CLEANLINESS OF DISHES IN A DISHWASHER

BACKGROUND OF THE INVENTION

1. Field of the Invention

The present invention relates to assemblies to determine the state of cleanliness of dishes in a dishwasher and more particularly pertains to indicating whether the dishes in a dishwasher are clean or dirty with an easily reversible sign.

2. Description of the Prior Art

The use of dishwasher indicating devices is known in the prior art. More specifically, dishwasher indicating devices heretofore devised and utilized for the purpose of indicating the status of a dishwasher are known to consist basically of familiar, expected, and obvious structural configurations, notwithstanding the myriad of designs encompassed by the crowded prior art which has been developed for the fulfillment of countless objectives and requirements.

The prior art discloses a large number of devices for indicating the state of a dishwasher. By way of example, U.S. Pat. No. 3,608,514 to Dunn discloses an automatic dishwasher indicator for cleaned or soiled dishes.

U.S. Pat. No. 3,807,418 to Jenkins discloses a dishwasher with soil detecting means.

U.S. Pat. No. 3,861,413 to Woehler and U.S. Pat. No. 4,129,954 to Hulteen disclose indicating devices for dishwashers.

U.S. Pat. No. 4,653,423 to Schafer discloses an automatic dishwasher condition indicator.

In this respect, assemblies to determine the state of cleanliness of dishes in a dishwasher according to the present invention substantially depart from the conventional concepts and designs of the prior art, and in doing so provide an apparatus primarily developed for the purpose of indicating whether the dishes in a dishwasher are clean or dirty with an easily reversible sign.

Therefore, it can be appreciated that there exists a continuing need for new and improved assemblies to determine the state of cleanliness of dishes in a dishwasher which can be used for indicating whether the dishes in a dishwasher are clean or dirty with an easily reversible sign. In this regard, the present invention substantially fulfills this need.

SUMMARY OF THE INVENTION

In view of the foregoing disadvantages inherent in the known types of dishwasher indicating devices now present in the prior art, the present invention provides improved assemblies to determine the state of cleanliness of dishes in a dishwasher. As such, the general purpose of the present invention, which will be described subsequently in greater detail, is to provide new and improved assemblies to determine the state of cleanliness of dishes in a dishwasher and methods which have all the advantages of the prior art and none of the disadvantages.

To attain this, the present invention essentially comprises a sign formed of a rigid material in a planar configuration and having a rectangular lower portion and a triangular upper portion, the lower portion having an upper edge, a lower edge, and vertical side edges therebetween with the lower edge being essentially four times greater than the side edges, the triangular portion having a lower edge and tapering side edges with the lower edge of the triangular portion being coextensive with the upper edge of the lower portion and with the side edges tapering upwardly to the center at an angle of about five degrees from the horizontal, the sign having a hole through the center of the triangular portion, the sign having writing on one side with the word DIRTY in Times New Roman and having on the other side the word CLEAN in Times New Roman. A suction cup is formed of an elastomeric material having an inboard segment and an outboard segment, the inboard segment being generally spherical in configuration with a periphery adapted to contact the exterior surface of a dishwasher and when pressed thereagainst to be held by suction thereto, the outboard segment having a cylindrical exterior cross-section with a central cylindrical recess, the recess having an interior component of a long length and a small diameter and an exterior component having a short length and large diameter to thereby form an exterior bearing surface between the two components. A wire eyelet has an interior portion and an exterior portion, the interior portion being generally linear in extent with a cone-shaped prong at its inboard end positionable within the interior component of the suction cup and with an enlarged flange having an interior bearing surface positionable in the exterior component of the suction cup with its interior bearing surface in contact with the exterior bearing surface of the suction cup, the exterior portion of the eyelet being formed in a circular loop with a small opening at its end adjacent to a central extent of the eyelet, the opening being of sufficient size to allow the sign to be moved therethrough with its hole supported by the eyelet whereby when the eyelet is positioned in the suction cup with the loop portion in a vertical plane, the sign may depend therefrom in a vertical plane to display one side of the sign with its word and whereby the eyelet may be turned 180 degrees within the suction cup to exhibit the other side of the sign with its word.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved assemblies to determine the state of cleanliness of dishes in a dishwasher which have all the advantages of the prior art dishwasher indicating devices and none of the disadvantages.

It is another object of the present invention to provide new and improved assemblies to determine the state of cleanliness of dishes in a dishwasher which may be easily and efficiently manufactured and marketed.

It is a further object of the present invention to provide new and improved assemblies to determine the state of cleanliness of dishes in a dishwasher which are of a durable and reliable construction.

An even further object of the present invention is to provide new and improved assemblies to determine the state of cleanliness of dishes in a dishwasher which are susceptible of a low cost of manufacture with regard to both materials and labor, and which accordingly are then susceptible of low prices of sale to the consuming public, thereby making such assemblies to determine the state of cleanliness of dishes in a dishwasher economically available to the buying public.

Still yet another object of the present invention is to provide new and improved assemblies to determine the state of cleanliness of dishes in a dishwasher which provide in the apparatuses and methods of the prior art some of the advantages thereof, while simultaneously overcoming some of the disadvantages normally associated therewith.

Even still another object of the present invention is to indicate whether the dishes in a dishwasher are clean or dirty with an easily reversible sign.

Lastly, it is an object of the present invention to provide an assembly to determine the state of cleanliness of dishes in a dishwasher comprising a sign formed of a rigid material in a planar configuration and having a rectangular lower portion and a triangular upper portion, the lower portion having an upper edge, a lower edge, and vertical side edges therebetween with the lower edge being greater than the side edges, the triangular portion having a lower edge and tapering side edges with the lower edge of the triangular portion being coextensive with the upper edge of the lower portion and with the side edges tapering upwardly to the center at an angle from the horizontal, the sign having a hole through the center of the triangular portion, the sign having writing on one side with a first word and having on the other side a second word. A suction cup is formed of an elastomeric material having an inboard segment and an outboard segment, the inboard segment being generally spherical in configuration with a periphery adapted to contact the exterior surface of a dishwasher and when pressed thereagainst to be held by suction thereto, the outboard segment having a cylindrical exterior cross-section with a central cylindrical recess. A wire eyelet has an interior portion and an exterior portion, the interior portion being generally linear in extent with a cone-shaped prong at its inboard end positionable within the interior component of the suction cup, the exterior portion of the eyelet being formed in a circular loop with a small opening at its end adjacent to a central extent of the eyelet, the opening being of sufficient size to allow the sign to be moved therethrough with its hole supported by the eyelet whereby when the eyelet is positioned in the suction cup with the loop portion in a vertical plane, the sign may depend therefrom in a vertical plane to display one side of the sign and whereby the eyelet may be turned 180 degrees within the suction cup to exhibit the other side of the sign.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the assembly of FIG. 1 but illustrating its orientation on a dishwasher.

FIG. 4 is a rear elevational view of the assembly shown in the prior Figure.

FIG. 5 is a cross-sectional view of the suction cup component of the assembly of the prior Figure taken along line 5—5 of FIG. 4.

FIG. 6 is a perspective view of the eyelet employed with the assembly of the prior Figures.

FIG. 7 is a perspective view of the eyelet similar to FIG. 6 but illustrating an alternate embodiment of the invention.

The same reference numerals refer to the same parts throughout the various Figures.

DESCRIPTION OF THE PREFERRED EMBODIMENT

Figure 1:
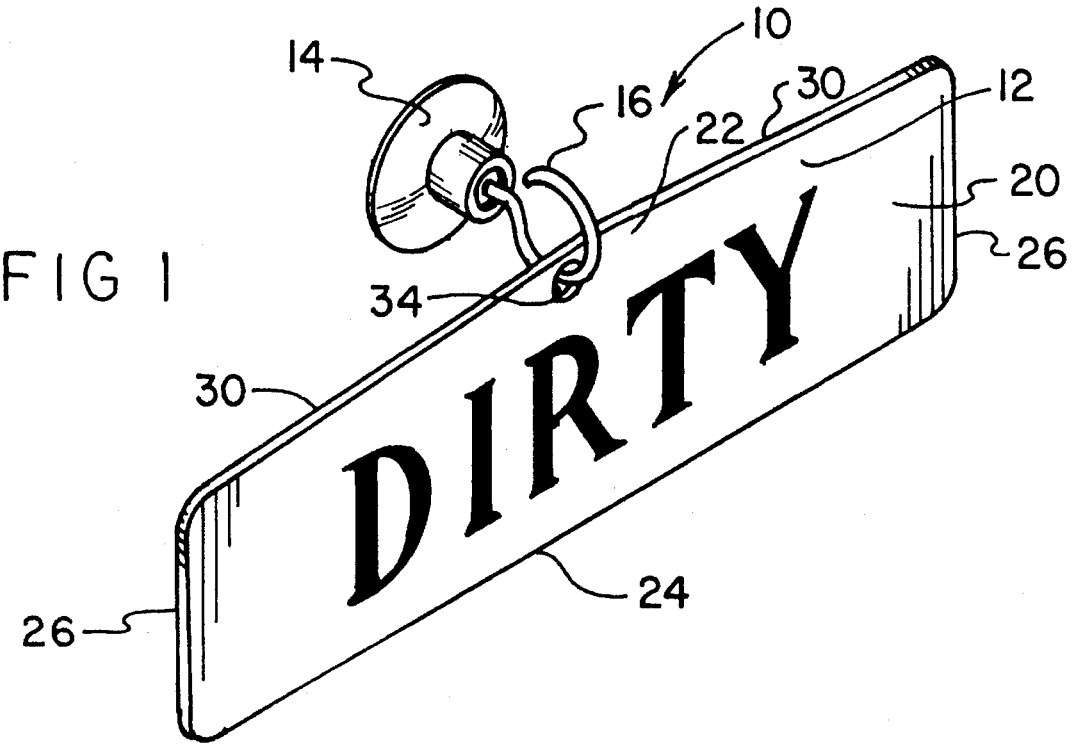
FIG. 1 is a perspective view of the preferred embodiment of the assemblies to determine the state of cleanliness of dishes in a dishwasher constructed in accordance with the principles of the present invention.
Figure 2:
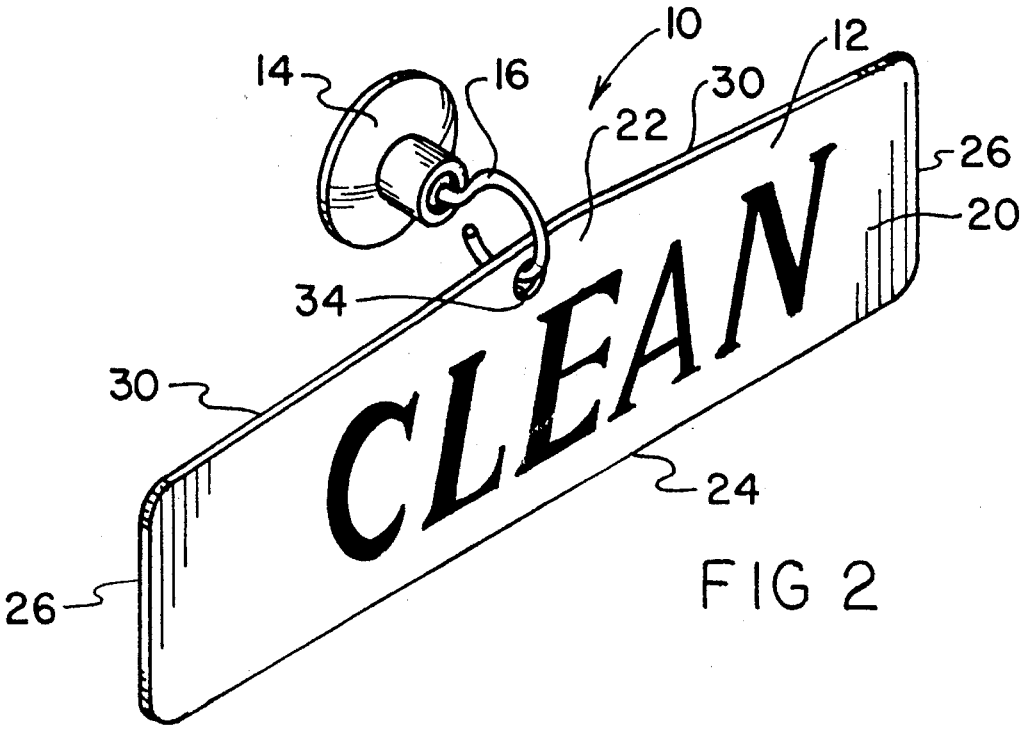
FIG. 2 is a perspective view of the assembly of FIG. 1 but with its sigh in an alternate orientation.
Figure 8:
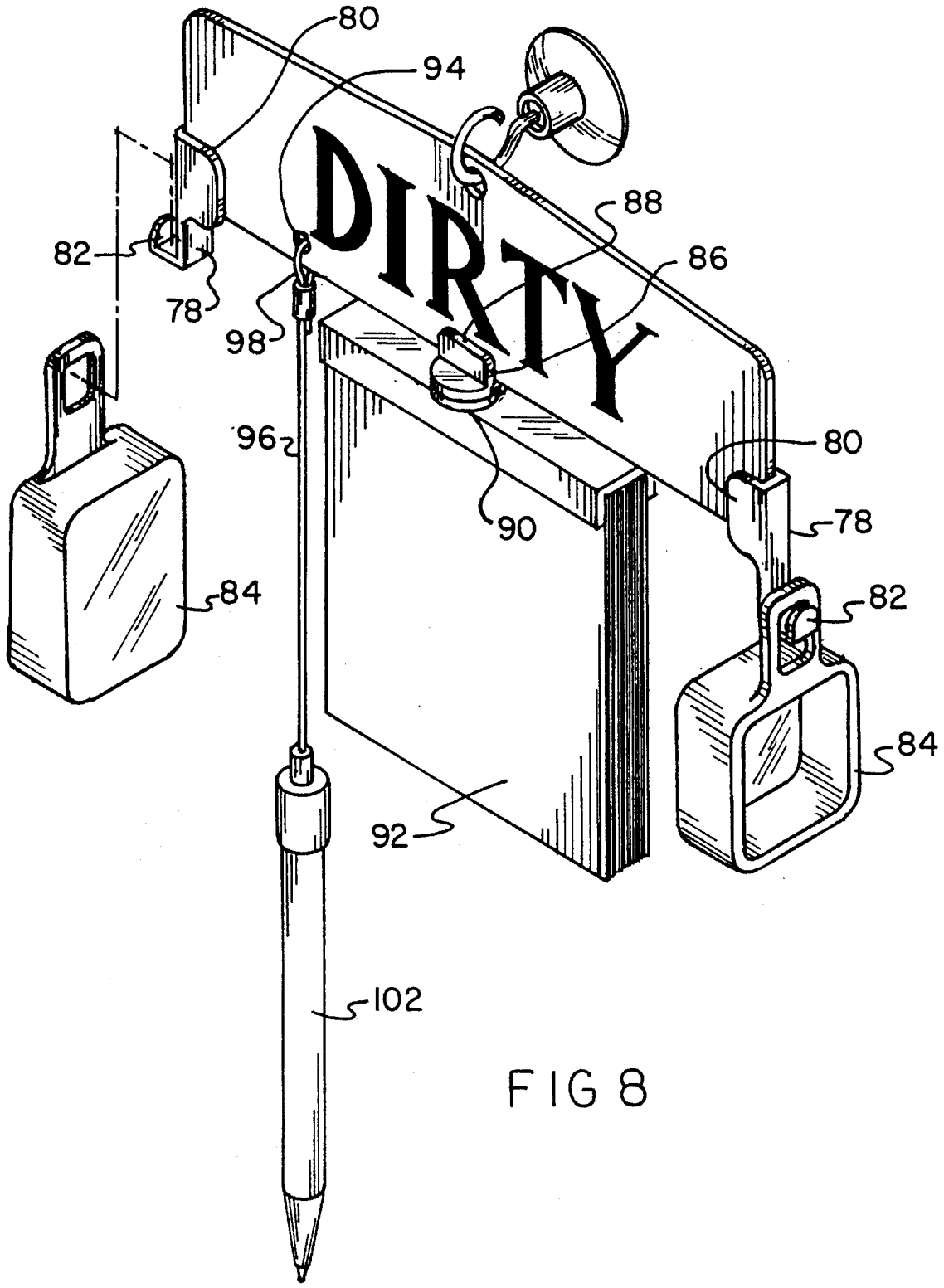
FIG. 8 is a perspective view of an alternate embodiment of the invention.

With reference now to the drawings, and in particular to FIG. 1 thereof, the preferred embodiment of the new and improved assemblies to determine the state of cleanliness of dishes in a dishwasher embodying the principles and concepts of the present invention and generally designated by the reference numeral 10 will be described.

Specifically, it will be noted in FIGS. 1 through 6 that there is shown the new and improved assembly 10 to determine the state of cleanliness of dishes in a dishwasher. In its broadest of terms, the invention includes a sign 12, a suction cup 14 and an eyelet 16 operatively coupled therebetween.

More specifically, the sign 12 is formed of a rigid material in a planar configuration. It may be of plastic or wood. The sign is formed of a rectangular lower portion 20 and a triangular upper portion 22. The lower portion has an upper edge, a lower edge 24, and vertical side edges 26 therebetween. The lower edge being essentially four times, plus or minus ten percent, greater than the side edges in the preferred embodiment.

The triangular portion 22 has a lower edge and tapering side edges 30. The lower edge of the triangular portion 22 coextensive with the upper edge of the lower portion 20. The side edges 30 taper upwardly to the center and form an angle of about five degrees, plus or minus ten percent, from the horizontal. The sign also has a hole 34 through the center of the triangular portion 22.

The sign is provided with writing. On one side is the word DIRTY, preferably in Times New Roman, to indicate dirty dishes in the dishwasher 38. The other side of the sign has the word CLEAN, preferably in Times New Roman, to indicate clean dishes in the dishwasher.

The second component of the assembly 10 is the suction cup 14 formed of an elastomeric material. It is formed with an inboard segment 42 and an outboard segment 44. The inboard segment is generally spherical in its configuration with a periphery adapted to contact the exterior surface of a dishwasher. When pressed thereagainst it is held thereto by suction.

The outboard segment 44 has a cylindrical exterior cross-section with a central cylindrical recess 46. The recess has an interior component 48 of a long length and a small diameter and an exterior component 50 of a short length and large diameter. Formed therebetween is a planar exterior bearing surface 52 between the two components 48 and 50.

Next provided is a wire eyelet 16. The eyelet has an interior portion 56 and an exterior portion 58. The interior portion 56 is generally linear in extent with a cone-shaped prong 60 at its interior end. The interior portion is positionable within the interior recess 48 of the suction cup 14. The interior portion has an enlarged flange 64 with an interior bearing surface 66. The interior bearing surface 66 is positionable against the exterior bearing surface 52 of the suction cup 14.

The exterior portion 58 of the eyelet 16 is formed in a circular loop with a small opening 70 at its outboard end adjacent to a central extent of the eyelet. The opening is of sufficient size to allow the sign to be moved therethrough with its hole 34 supported on the eyelet 16. When the eyelet 16 is positioned in the suction cup, with the exterior loop portion 58 in a vertical plane, the sign 12 will depend therefrom in a vertical plane. This will display one side of the side with its word. When the eyelet 16 is turned 180 degrees within the suction cup 14, it will display the other side of the sign with its word. Compare FIGS. 1 and 2.

An alternate embodiment of the invention is shown in FIG. 7. In such alternate embodiment, the flange of the eyelet 74 is removed. In such embodiment the recess of the suction cup is of a common smaller diameter for its entire length. Such embodiment is preferred when the sign is of a lighter material such as plastic where extra support from the bearing surfaces is not required.

Another alternate embodiment is shown in FIG. 7. In such embodiment, supplemental devices are provided for attaching kitchen related implements to the sign 12 when in use. Such devices include a bracket 78 having an upper end 80 adapted to frictionally grasp an edge of the sign. A lower edge 82 is formed as a hook and is adapted to support a measuring cup 84 or like implement. A supplemental bracket 86 is also provided and is adapted at its upper end 88 to grasp a lower central extent of the sign and at its lower end 90 to support a notepad 92 as through an adhesive coupling. An additional aperture 94 with a string 96 has a loop 98 at its upper end adapted to be supported by the aperture 94. Its lower end supports a pen 102 for writing on the notepad 92.

The present invention, as the name suggests, is designed to indicate whether the dishes and other articles currently within an automatic dishwasher are clean or dirty. It is basically rectangular in shape and measures, in its preferred embodiment, five inches wide by one and one half inches high. The top edge is tapered from both ends at about a five degree angle to an apex at its midpoint, and a three sixteenth of an inch diameter hole is located just below this apex. It can be made of solid plastic or varnished wood.

The word "DIRTY" is emblazoned on one side in Times New Roman bold font with letters that are three quarters of an inch high while the word "CLEAN" is imprinted on the reverse side in similar font and size, but using italics. A wire eyelet with a conical prong and flange is included, and this features a one half inch diameter loop with a gap of one eighth of an inch. This can be mounted to the washer using a thumbtack or a suction cup with a similar receptacle.

From the foregoing description, the use of the present invention becomes fairly obvious. The "CLEAN" sign is displayed just after the machine cycle has been completed, and the "DIRTY" sign is used just after loading the machine. This is quickly and easily accomplished by simply rotating the eyelet 180 degrees and letting the sign fall to the opposite side of the eyelet which reverses the display; it is not necessary to remove the sign. The present invention will be a beneficial addition to any household with an automatic dishwasher since everyone will know whether or not dishes and other articles within the machine may be used safely.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved assembly to determine the state of cleanliness of dishes in a dishwasher comprising, in combination:

a planar sign formed of a rigid material in a pentagon configuration and having a lower edge, and opposed second and third side edges extending 90 degrees from opposite ends of the lower edge, with the length of the lower edge being essentially four times greater than the second and third side edges, and fourth and fifth side edges extending upwardly from the end of the second and third opposite side edges of the lower first edge and intersecting at an upper center point the sign having a hole near the upper center point, the sign having the word DIRTY printed on one side thereof and having the word CLEAN printed on the other side thereof;

a suction cup formed of an elastomeric material having an inboard segment and an outboard segment, the inboard segment being generally hemispheric in configuration with a periphery adapted to contact an exterior surface of a dishwasher and when pressed thereagainst to be held by suction thereto, the outboard segment having a cylindrical exterior cross-section with a central cylindrical recess, the recess having an interior component of a predetermined length and a predetermined diameter and an exterior component having a length shorter than the length of the interior component and large diameter larger than the diameter of the interior component to thereby form an exterior bearing surface between the interior and exterior components;

a wire eyelet having an interior portion and an exterior portion, the interior portion being generally linear in extent with a cone-shaped prong at one end positioned within the interior component of the suction cup and with an enlarged flange having an interior bearing surface positioned in the exterior component of the suction cup with its interior bearing surface in contact with the exterior bearing surface of the suction cup, the exterior portion of the eyelet being formed in a circular loop with a small opening at the other end adjacent to a central extent of the eyelet, and with the hole on the sign being of sufficient size to allow the loop of the eyelet to be moved therethrough whereby when the prong of the eyelet is positioned in the suction cup with the loop of the eyelet extended within the hole on the sign and positioned in a vertical plane, the sign may depend therefrom in another vertical plane to display one side of the sign and whereby the eyelet may be turned 180 degrees within the suction cup to display the other side of the sign; and supplemental devices for attaching kitchen related implements to the sign when in use, such devices including a first bracket having an upper end adapted to grasp one of the second or third side edges of the sign and a lower end adapted to support a measuring cup, a supplemental bracket having an upper end to grasp the lower edge of the sign and a lower end to support a notepad and an additional aperture in the sign with a string having a loop at an upper end supported by the additional aperture and having a lower end for supporting a pen for writing on the notepad.

2. An assembly to determine the state of conditions comprising:

a planar sign formed of a rigid material in a pentagon configuration and having a lower edge and opposed second and third side edges extending 90 degrees from opposite ends of the lower edge therefrom, and having fourth and fifth side edges extending upwardly from the ends of the second and third opposed side edges of the lower edge to a center point, the sign having a hole near the center point, the sign having writing on one side with a first word and having writing on the other side with a second word;

a suction cup formed of an elastomeric material having an inboard segment and an outboard segment, the inboard segment being generally hemispheric in configuration with a periphery adapted to contact a recipient surface and when pressed thereagainst to be held by suction thereto, the outboard segment having a cylindrical exterior cross-section with a central cylindrical recess; and a wire eyelet having an interior portion and an exterior portion, the interior portion being generally linear in extent with a prong at one end positioned within the recess of the suction cup, the exterior portion of the eyelet being formed in a generally circular loop with a small opening at the other end adjacent to a central extent of the eyelet, and with the hole on the sign being of sufficient size to allow the loop of the eyelet to be moved therethrough whereby when the prong of the eyelet is positioned in the suction cup with the loop of the eyelet is extended within the hole on the sign and positioned in a vertical plane, the sign may depend therefrom in another vertical plane to display one side of the sign and whereby the eyelet may be turned 180 degrees within the suction cup to display the other side of the sign; and supplemental devices for attaching kitchen related implements to the sign when in use, such devices including a bracket having an upper end adapted to grasp one of the second or third side edges of the sign and a lower edge adapted to support a measuring cup, a supplemental bracket having an upper end to grasp the lower edge of the sign and a lower end to support a notepad and an additional aperture in the sign with a string having a loop at an upper end supported by the additional aperture and having a lower end for supporting a pen for writing on the notepad.

* * * * *